US010144024B1

(12) United States Patent
Mei

(10) Patent No.: US 10,144,024 B1
(45) Date of Patent: Dec. 4, 2018

(54) SINGLE-HAND PRESSED FOAM PUMP HEAD AND CONTAINER THEREOF

(71) Applicant: Yuanhong Mei, Zhongshan (CN)

(72) Inventor: Yuanhong Mei, Zhongshan (CN)

( * ) Notice: Subject to any disclaimer, the term of this patent is extended or adjusted under 35 U.S.C. 154(b) by 0 days.

(21) Appl. No.: 15/610,647

(22) Filed: Jun. 1, 2017

(51) Int. Cl.

| | |
|---|---|
| ***B05B 11/00*** | (2006.01) |
| ***B05B 7/00*** | (2006.01) |
| ***B65D 41/04*** | (2006.01) |
| ***B65D 1/02*** | (2006.01) |

(52) U.S. Cl.
CPC ..... *B05B 11/3052* (2013.01); *B05B 7/0018* (2013.01); *B05B 11/3045* (2013.01); *B05B 11/3073* (2013.01); *B65D 1/0246* (2013.01); *B65D 41/04* (2013.01)

(58) Field of Classification Search
CPC ..... B05B 7/0018; B05B 11/3045; B05B 11/3052
USPC ..... 222/321.2, 321.6–321.9, 631, 636, 190, 222/322, 341, 385; 239/331, 333, 590
See application file for complete search history.

(56) References Cited

U.S. PATENT DOCUMENTS

| | | | | |
|---|---|---|---|---|
| 5,842,607 | A * | 12/1998 | Snider | A45D 27/10 222/145.6 |
| RE38,077 | E * | 4/2003 | Cohen | A61F 9/0008 239/333 |
| 6,547,162 | B1 * | 4/2003 | de Regt | B05B 11/3087 222/190 |
| 8,356,732 | B2 * | 1/2013 | van der Heijden | B05B 7/0018 222/190 |
| 8,616,414 | B2 * | 12/2013 | Ciavarella | B05B 7/0037 222/1 |
| 2007/0145078 | A1 * | 6/2007 | Cohen | B05B 11/0032 222/321.7 |
| 2013/0284763 | A1 * | 10/2013 | Banks | B01F 5/0478 222/190 |

* cited by examiner

*Primary Examiner* — Vishal Pancholi
(74) *Attorney, Agent, or Firm* — Gokalp Bayramoglu

(57) ABSTRACT

A single-hand pressed foam pump head comprises a pump filled with foam liquid or emulsion. A spring is provided inside the pump. The pump comprises a press head and a fixed outflow cap; the fixed outflow cap is provided with a vertical connecting tube and is connected to a connecting end of a bottle; the connecting tube has a foam or liquid channel. A top portion of the connecting tube is provided with a horizontal connecting channel. The horizontal connecting channel is connected to a vertical plugged-in tube. When the connecting tube is pressed downward such that the vertical plugged-in tube is inserted into an outflow chamber of the fixed outflow cap, the connecting tube and the outflow chamber are connected to each other to form a top outflow channel. The present invention is simple in structure, stable in function and convenient for people to use.

6 Claims, 2 Drawing Sheets

SINGLE-HAND PRESSED FOAM PUMP HEAD AND CONTAINER THEREOF

TECHNICAL FIELD

The present invention relates to the field of container technology, and more particularly to a single-hand pressed foam pump head. In addition, the present invention relates to a container having the single-hand pressed foam pump head.

BACKGROUND

Currently, for the convenience of use, most of the daily chemicals that are available in the market use pump heads. However, there are very few types of pump heads, but there are many drawbacks in the actual use. The drawbacks are mainly reflected in the following aspects.

(1) The user needs to use two hands to operate such that the use becomes relatively inconvenient.

(2) If the conventional foam pump bead or emulsion pump head is operated with a single hand, since the design of this pump head makes it inconvenient for one hand holding, the bottle body is easy to topple over during the operation, causing inconvenience in use.

(3) When operating conventional foam pump head or emulsion pump head with a single hand, the user needs greater strength to operate due to the limitation of the usage mode of the pump head. Therefore, the use is not convenient.

(4) The phenomenon that the liquid spills or splashes often appears since the outlet is subject to vibration and pressure.

Therefore, it is pointed out in the present invention that, regarding the above aspects, it is necessary to innovate the existing technology for many problems to be solved and extendable technical aspects.

SUMMARY OF THE INVENTION

In view of the above drawbacks, the present invention provides a single-hand pressed foam pump head and a container thereof, which are simple in structure, stable in function and convenient for people to use, to solve many deficiencies of the prior art.

In order to achieve above purposes, the present invention provides the following technical solutions.

A single-hand pressed foam pump head comprises a pump filled with foam liquid or emulsion. A spring is provided inside the pump. The pump comprises a press head and a fixed outflow cap; the fixed outflow cap is provided with a vertical connecting tube and is connected to a connecting end of a bottle; the connecting tube has a foam or liquid channel. A top portion of the connecting tube is provided with a horizontal connecting channel. The horizontal connecting channel is connected to a vertical plugged-in tube. When the connecting tube is pressed downward such that the vertical plugged-in tube is inserted into an outflow chamber of the fixed outflow cap, the connecting tube and the outflow chamber are connected to each other to form a top outflow channel.

Preferably, the plugged-in pipe and the liquid channel form an inverted U-shape conduit.

Preferably, a pressing recess is provided on the press head, and the connecting tube is embedded in the pressing recess. The upper end of the fixed outflow cap encompasses the press cap and a recess is provided at a place where the pressing is conducted to avoid interference with fingers. The main purpose is to prevent an external force from colliding with the press cap, squeezing the internal engine pump and causing a leak. Especially when an express company delivers products, this structure can well protect the functional integrity of the pump.

Preferably, a sum of the length of the plugged-in tube and the length of the outflow chamber is more than the length of the liquid channel of the connecting tube.

The present invention further provides a container with the single-hand pressed foam pump head, comprising a bottle, a pump filled with foam liquid or emulsion, and a suction tube. The pump comprises a press head and a fixed outflow cap. The fixed outflow cap is provided at an opening of the bottle. The fixed outflow cap is provided with a vertical connecting tube and is connected to a connecting end of the bottle through the connecting tube. A connecting end of the connecting tube is fixedly connected to the press head. When the press head is pressed downward such that the press head moves downward a certain distance relative to the fixed outflow cap, the plugged-in tube moves into the outflow chamber for a certain depth such that the pump is in a working status. Due to the pressure applied to the press head, the plugged-in tube moves up and down in the channel of the outflow chamber of the fixed outflow cap and performs a connection function, and the suction tube sucks the liquid repeatedly.

Accordingly, the fixed outflow cap is connected to the bottle through thread, the opening of the bottle is provided with an external thread, and an inner side of the fixed outflow cap is provided with an internal thread. The bottle is connected to the fixed outflow cap through thread.

The beneficial effects of the single-hand pressed foam pump head and the container thereof of the present invention are as follows.

(1) When the pump is in the working status, a foam or liquid channel of the connecting tube is connected to a central outflow end of the fixed outflow cap. Due to the pressure applied to the press head, the plugged-in tube moves up and down in the channel of the outflow chamber of the fixed outflow cap and performs a connection function, and the suction tube sucks the liquid repeatedly. Thus, the fixation of pump outlet with a single hand operation is achieved.

(2) The present invention is simple in structure, stable in function and convenient for people to use.

(3) A unique top outflow channel is formed by the connecting tube and the outflow chamber. The spill or splash of liquid caused by pressure or vibration acting on the press head can be prevented. Thus, a spill-proof structure is formed.

(4) The present invention can be widely applied to all types of liquid containers. When the pump is replaced, the original connecting tube or fixed outflow cap needs not to be replaced.

BRIEF DESCRIPTION OF THE DRAWINGS

The present invention will now be described in further detail with reference to the accompanying drawings.

Figure 1:
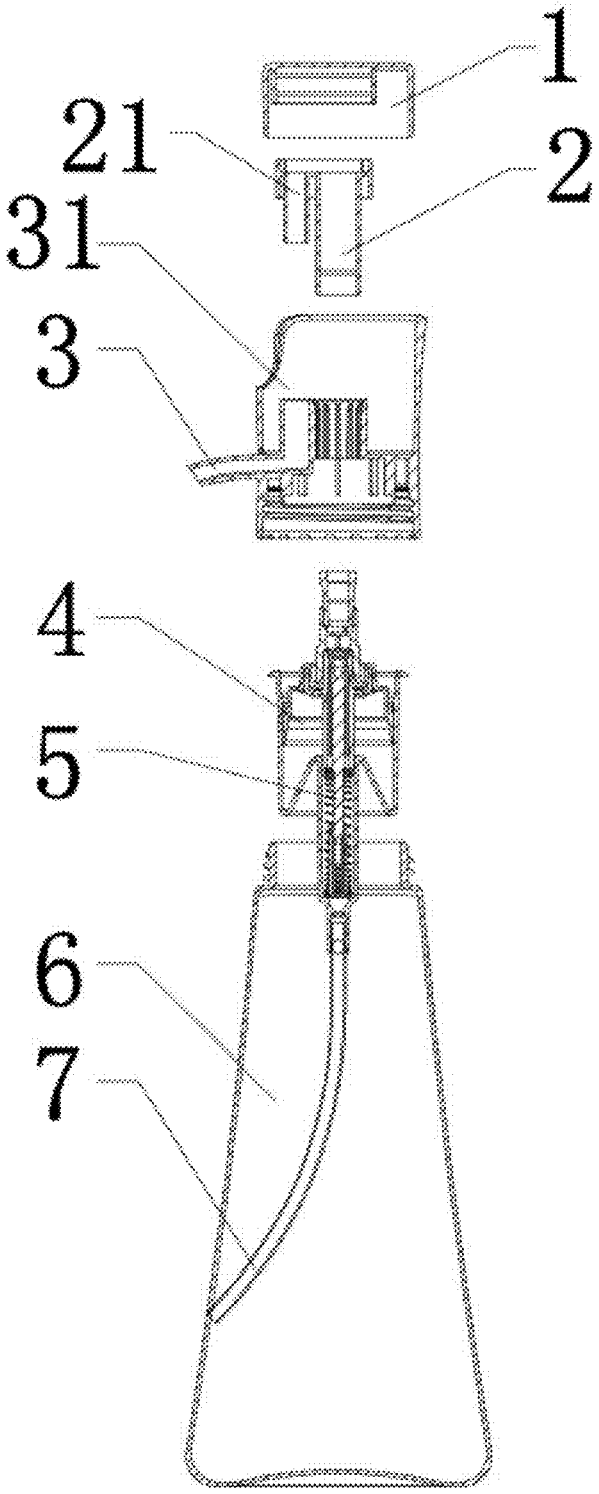
FIG. 1 is an exploded schematic diagram of an embodiment of the present invention.

In the drawings: 1. press head; 2. connecting tube; 3. fixed outflow cap; 4. pump; 5. spring; 6. bottle; 7. suction tube; 21. plugged-in tube; 31. outflow chamber.

DETAILED DESCRIPTION

The technical solutions in the embodiments of the present invention will now be clearly and completely described in conjunction with the accompanying drawings in the embodiments of the present invention. It will be apparent that the described embodiments are merely certain embodiments of the present invention and are not intended to be exhaustive. The specific embodiments described herein are merely illustrative and are not intended to limit the invention. All other embodiments obtained by those of ordinary skill in the art based on the embodiments in the present invention without making creative work are within the scope of the present invention.

Embodiment 1

Figure 2:
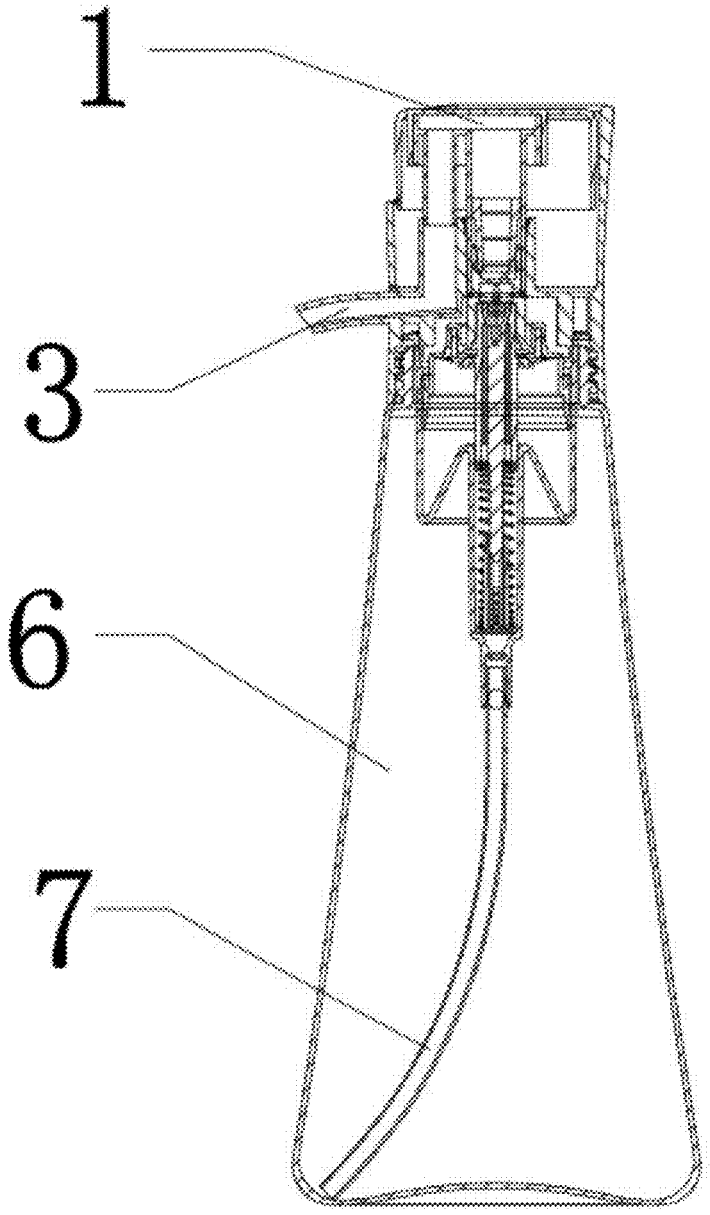
FIG. 2 is a cross-sectional view of an embodiment of the present invention.

As shown in FIG. 1 and FIG. 2, a container with a single-hand pressed foam pump head and emulsion pump head comprises bottle 6, and pump 4 filled with foam liquid or emulsion. Spring 5 is disposed in pump 4. Pump 4 comprises press head 1, connecting tube 2, fixed outflow cap 3, and air inflow controller. Fixed outflow cap 3 is disposed at the opening of bottle 6. Fixed outflow cap 3 is provided with a length of vertical connecting tube 2 and connected to a connecting end of bottle 6 through connecting tube 2. A connecting end of connecting tube 2 is fixedly connected to press head 1.

When press head 1 is pressed down to move downward a certain distance relative to fixed outflow cap 3, plugged-in tube 21 moves into outflow chamber 31 for a certain depth such that pump 4 is in a working status, i.e., outflow status.

When pump 4 is in the working status, a foam or liquid channel of connecting tube 2 is connected to a central outflow end of fixed outflow cap 3. Due to the pressure applied to press head 1, plugged-in tube 21 moves up and down in the channel of outflow chamber 31 of fixed outflow cap 3 and performs connection function, and suction tube 7 sucks the liquid repeatedly. Thus, the fixation of pump outlet with a single hand operation is achieved.

The connecting structure between connecting tube 2 and fixed outflow cap 3 comprises the following technical features.

Connecting tube 2 has a foam or liquid channel. A horizontal connecting channel is provided at the top of connection tube 2. The horizontal connecting channel is connected to a vertically downward plugged-in tube 21. When connecting tube 2 is pressed down such that plugged-in tube 21 is inserted in outflow chamber 31 of fixed outflow cap 3, connecting tube 2 and outflow chamber 31 forms a top outflow channel which is in a connecting state.

Accordingly, plugged-in tube 21 and the liquid channel form an inverted U-shape conduit.

In the container with a single-hand pressed foam pump head or emulsion pump head as described above, fixed outflow cap 3 is connected to bottle 6 through thread. External thread is provided at the opening of bottle 6. Internal thread is provided on the inner side of fixed outflow cap 3. Bottle 6 is connected to fixed outflow cap 3 through thread.

Embodiment 2

As shown in FIG. 1 and FIG. 2, a single-hand pressed foam pump head comprises pump 4 filled with foam liquid or emulsion. Spring 5 is disposed in pump 4. Pump 4 comprises press head 1, fixed outflow cap 3. Fixed outflow cap 3 is provided with a vertical connecting tube 2 and connected to a connecting end of bottle 6 through connecting tube 2. Connecting tube 2 comprises a foam or liquid channel. A horizontal connecting channel is provided at the top of connection tube 2. The horizontal connecting channel is connected to a vertically downward plugged-in tube 21. When connecting tube 2 is pressed down such that plugged-in tube 21 is inserted in outflow chamber 31 of fixed outflow cap 3, connecting tube 2 and outflow chamber 31 connects with each other and forms a top outflow channel. One end of connecting tube 2 is partially embedded in hollow pump 4, the other end (outlet) of connecting tube 2 is inserted into a fixed outflow channel of fixed outflow cap 3 and can reciprocate therein.

In addition, the container comprises press head 1, which is embedded above connecting tube 2. Press head 1 can reciprocate.

An outflow outlet of pump 4 is connected to connecting tube 2 in a linkage connection.

In the single-hand pressed foam pump head of the present invention, the user can put the index finger at the foam outlet of the nozzle and use the thumb to press the top of press head to some extent. During the pressing process, pump 4 is connected to the liquid channel of fixed outflow cap 3 and connecting tube 2 and is open. During the pressing process, connecting tube 2 moves downward to introduce the liquid or foam in pump 4 into the liquid channel of fixed outflow cap 3 to let the liquid or foam flow out.

The foregoing description of the embodiments is intended to facilitate one of ordinary skill in the art to understand and apply the present invention. It will be apparent to those skilled in the art that various modifications may be made to these embodiments and that the generic principles described herein can be applied to other embodiments without creative work. Accordingly, the present invention is not limited to the above embodiments, and improvements and modifications, for example, size or diameter of tube, model of pump, position of outflow tube of outflow cap, etc., to the present invention by the skilled in the art in accordance with the present disclosure should be in the scope of protection of the invention if not going beyond the beneficial effects of the present invention.

What is claimed is:

1. A single-hand pressed foam pump head comprising:

a pump filled with foam liquid or emulsion, wherein a spring is provided inside the pump;

the pump comprises a press head and a fixed outflow cap;

the fixed outflow cap is provided with a vertical connecting tube and can be connected to a connecting end of a bottle through the vertical connecting tube;

the vertical connecting tube includes a foam channel or a liquid channel;

a top portion of the vertical connecting tube is provided with a horizontal connecting channel;

the horizontal connecting channel is connected to a vertical plugged-in tube;

wherein the vertical connecting tube and the vertical plugged-in tube are a single device;

when the vertical connecting tube is pressed downward such that the vertical plugged-in tube is inserted into an outflow chamber of the fixed outflow cap, the vertical connecting tube and the outflow chamber are connected to each other to form a top outflow channel.

2. The single-hand foam pump head according to claim 1, wherein the vertical plugged-in tube and the liquid channel form an inverted U-shape conduit.

3. The single-hand pressed foam pump head according to claim 1, wherein a pressing recess is provided on the press head, and the vertical connecting tube is embedded in the pressing recess.

4. The single-hand pressed foam pump head according to claim 1, wherein a sum of the length of the plugged-in tube and the length of the outflow chamber is more than the length of the liquid channel of the vertical connecting tube.

5. A container comprising a single-hand pressed foam pump head, a bottle, a pump filled with foam liquid or emulsion, and a suction tube, wherein the pump comprises a press head a fixed outflow cap, a spring is provided inside the pump;

the fixed outflow cap is provided at an opening of the bottle;

the fixed outflow cap is provided with a vertical connecting tube and is connected to a connecting end of the bottle through the vertical connecting tube;

the connecting end of the vertical connecting tube is fixedly connected to the press head;

the vertical connecting tube has a foam channel or liquid channel;

a top portion of the vertical connecting tube is provided with a horizontal connecting channel;

the horizontal connecting channel is connected to a vertical plugged-in tube;

wherein the vertical connecting tube and the vertical plugged-in tube are a single device;

when the vertical connecting tube is pressed downward such that the vertical plugged-in tube is inserted into an outflow chamber of the fixed outflow cap, the vertical connecting tube is inserted into the outflow chamber of the fixed outflow cap, the vertical connecting tube and the outflow chamber are connected to each other to form a top outflow channel.

6. The container having the single-hand pressed foam pump head according to claim 5, wherein the fixed outflow cap is connected to the bottle through threads, the opening of the bottle is provided with an external thread, and an inner side of the fixed outflow cap is provided with an internal thread.

* * * * *